United States Patent [19]

Ducharme

[11] Patent Number: 4,695,288

[45] Date of Patent: Sep. 22, 1987

[54] SUBBING LAYER FOR DYE-DONOR ELEMENT USED IN THERMAL DYE TRANSFER

[75] Inventor: Gerald L. Ducharme, Rochester, N.Y.

[73] Assignee: Eastman Kodak Company, Rochester, N.Y.

[21] Appl. No.: 916,138

[22] Filed: Oct. 7, 1986

[51] Int. Cl.[4] ..... B41M 5/26

[52] U.S. Cl. ..... 8/471; 427/146; 427/256; 428/195; 428/207; 428/483; 428/500; 428/508; 428/510; 428/515; 428/520; 428/522; 428/532; 428/913; 428/914; 430/945

[58] Field of Search ..... 8/470, 471; 427/256, 427/146; 428/195, 207, 480, 483, 500, 508, 510, 515, 520, 522, 532, 913, 914; 430/945

[56] References Cited

U.S. PATENT DOCUMENTS

| | | | |
|---|---|---|---|
| 4,027,345 | 6/1977 | Fujisawa et al. | 428/914 |
| 4,541,830 | 9/1985 | Hotta et al. | 428/207 |
| 4,559,273 | 12/1985 | Kutsukake et al. | 8/471 |

FOREIGN PATENT DOCUMENTS

| | | | |
|---|---|---|---|
| 19138 | 6/1985 | Japan | 8/471 |

*Primary Examiner*—Bruce H. Hess
*Attorney, Agent, or Firm*—Harold E. Cole

[57] ABSTRACT

A dye-donor element for thermal dye transfer comprising a poly(ethylene terephthalate) support having thereon, in order, a subbing layer and a dye layer comprising a dye dispersed in a cellulosic binder, and wherein said subbing layer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

18 Claims, No Drawings

SUBBING LAYER FOR DYE-DONOR ELEMENT USED IN THERMAL DYE TRANSFER

This invention relates to dye-donor elements used in thermal dye transfer, and more particularly to the use of a particular subbing layer between a poly(ethylene terephthalate) support and a dye layer comprising a dye dispersed in a cellulosic binder.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sept. 23, 1985, the disclosure of which is hereby incorporated by reference.

A problem has existed with the use of dye-donor elements for thermal dye-transfer printing because a thin support is required in order to provide effective heat transfer. For example, when a thin polyester film is employed, there is a greater tendency for layer delamination. While various subbing layers have been developed for photographic applications, they are not all suitable for thermal dye transfer, since dye layers for thermal systems are not gelatin based as most photographic emulsions are.

It would be desirable to provide a subbing layer for dye-donor elements used in thermal dye transfer which would provide superior adhesion between a poly(ethylene terephthalate) support and a dye layer comprising a cellulosic binder.

In Japanese laid open publication No. 19,138/85, an image-receiving element for thermal dye transfer printing is disclosed. In Example 3 of that publication, a dye-donor element is also described which indicates that a gelatin subbing layer of 2 g/m$^2$ is located between the dye layer and the support. The subbing layers of this invention provide better adhesion than gelatin layers, as will be shown by comparative tests hereinafter.

A dye-donor element according to this invention for thermal dye transfer comprises a poly(ethylene terephthalate) support having thereon, in order, a subbing layer and a dye layer comprising a dye dispersed in a cellulosic binder, and wherein the subbing layer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride.

Any ethylenically unsaturated monomer which is different from the other monomers in the polymer can be used to prepare the polymer described above including alkyl acrylates and methacrylates such as methyl acrylate, ethyl acrylate, propyl acrylate, butyl acrylate, or butyl methacrylate; vinyl esters, amides, nitriles, ketones, halides, ethers, olefins, or diolefins as exemplified by acrylonitrile, methacrylonitrile, styrene, $\alpha$-methyl styrene, acrylamide, methacrylamide, vinyl chloride, methyl vinyl ketone, fumaric, maleic and itaconic esters, 2-chloroethylvinyl ether, dimethylaminoethyl methacrylate, 2-hydroxyethyl methacrylate, N-vinylsuccinamide, N-vinylphthalamide, N-vinylpyrrolidone, butadiene, or ethylene. A preferred monomer is acrylonitrile.

Examples of ethylenically unsaturated carboxylic acids which can be included in the polymer described above include acrylic acid, methacrylic acid, itaconic acid, fumaric acid, maleic acid, or their anhydrides. The preferred carboxylic acids are acrylic acid and itaconic acid.

In a preferred embodiment of the invention, the subbing layer comprises from about 5 to about 35 percent by weight of acrylonitrile, from about 2 to about 10 percent by weight of acrylic acid, and from about 55 to about 85 percent by weight of recurring units of vinylidene chloride.

The subbing layer of the invention may be employed at any concentration which is effective for the intended purpose. In general, good results have been obtained at from about 0.03 to about 1.0 g/m$^2$ of coated element.

Any cellulosic binder may be employed in the dye-donor element of the invention. For example, there may be employed cellulose acetate, cellulose triacetate (fully acetylated) or a cellulose mixed ester such as cellulose acetate butyrate, cellulose acetate hydrogen phthalate, cellulose acetate formate, cellulose acetate propionate, cellulose acetate pentanoate, cellulose acetate hexanoate, cellulose acetate heptanoate, or cellulose acetate benzoate. In a preferred embodiment, cellulose acetate butyate is employed.

The cellulosic binder of the invention may be employed at any concentration which is effective for the intended purpose. In general, good results have been obtained at from about 0.1 to about 5 g/m$^2$ of coated element.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

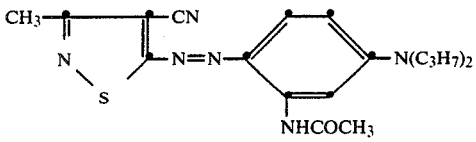

(magenta)

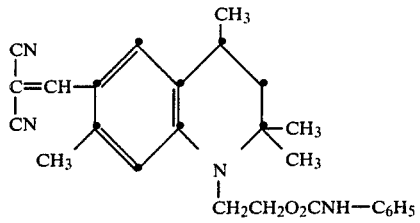

(yellow)

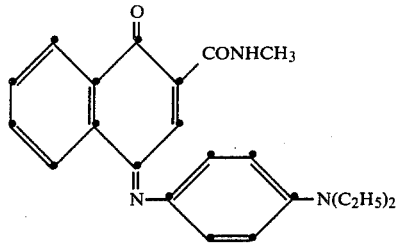

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye layer of the dye-donor element may be coated on the support or printed thereon by a printing technique such as a gravure process.

The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 weight %, preferable 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magneta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magneta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

(A) A magneta dye-donor element in accordance with the invention was prepared by gravure coating the following layers in the order recited on a 6 μm poly(ethylene terephthalate) support:

(1) Subbing layer of poly(acrylonitrile-co-vinylidene chloride-co-acrylic acid) (14:79:7 weight ratio) (0.059 g/m$^2$), coated from 3-pentanone solvent, and (2) Dye layer containing the following magenta dye (0.20 g/m$^2$), and cellulose acetate propionate binder (2.5% acetyl and 45% propionyl) (0.41 g/m$^2$) coated from a toluene/methanol/cyclopentanone solvent mixture (65/30/5).

Magenta Dye

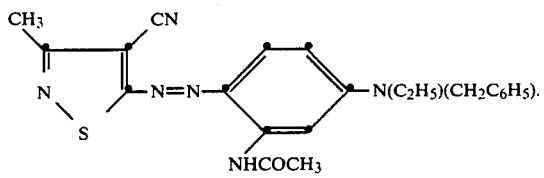

(B) A control dye-donor element was prepared similar to (A), except that there was no subbing layer.

(C) A control dye-donor element was prepared similar to (A), except that the subbing layer was gelatin nitrate (gelatin, cellulose nitrate and salicyclic acid in approximately 20:5:2 weight ratio in a solvent of acetone, methanol and water).

Each dye-donor element was subjected to a tape adhesion test. A small area (approximately ½ inch×2 inches) of 3M Highland® 6200 Permanent Mending Tape was firmly pressed by hand to the top of the element leaving enough area free to serve as a handle for pulling the tape. Upon manually pulling the tape, none of the dye layer would be removed in an ideal situation. When dye layer was removed, this indicated a weak bond between the support and the coated dye layer. The following categories were established:

E—excellent (no dye layer removal),

G—good (negligible quantities and areas of dye layer removal),

F—fair (small quantities and areas of dye layer removal),

P—poor (substantial areas of dye layer removal),

U—unacceptable (dye layer completely removed).

The following results were obtained:

| Donor Element | Tape Test |
|---|---|
| A | E |
| B | P |
| C | P |

The results indicate that the donor element having the subbing layer in accordance with the invention provided excellent adhesion, in contrast to the control elements having no subbing layer or a conventional subbing layer used in the photographic art which had poor adhesion.

EXAMPLE 2

(A) A cyan dye-donor element in accordance with the invention was prepared by gravure coating the following layers in the order recited on a 6 μm poly(ethylene terephthalate) support:

(1) Subbing layer of poly(acrylonitrile-co-vinylidene chloride-co-acrylic acid) (14:79:7 weight ratio) (0.059 g/m$^2$), coated from 3-pentanone solvent, and (2) Dye layer containing the following cyan dye (0.28 g/m$^2$), and cellulose acetate butyrate binder (28% acetyl and 17% butyryl) (0.504 g/m$^2$) coated from a toluene/methanol solvent mixture (70/30).

Cyan Dye

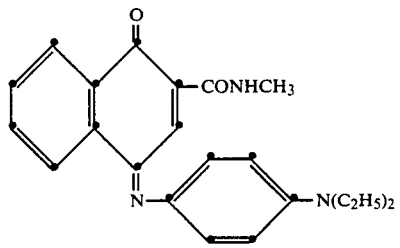

(B) A control dye-donor element was prepared similar to (A), except that the subbing layer was Bostik 7650 (a solution of linear saturated polyester, presumably aliphatic) supplied by the Bostik Chemical Group of Emhart Corp.

The tape adhesion test was run as described in Example 1. The following results were obtained:

| Donor Element | Tape Test |
|---|---|
| A | E |
| B | P |

The results again indicate that the donor element having the subbing layer in accordance with the invention provided excellent adhesion, in contrast to the control element having a commercially available subbing layer.

EXAMPLE 3-COMPARATIVE TEST (A) Magenta dye-donor elements in accordance with the invention were prepared as in Example 1 except that the subbing layer was coated at 0.11 g/m$^2$ and at 0.43 g/m$^2$.

(B) Control dye-donor elements were prepared as in (A), except that the subbing layer was gelatin (non-deionized, non volatile acid-base manufacture photographic grade, coated from aqueous solution) coated at 0.11 g/m$^2$ and at 0.43 g/m$^2$.

The tape adhesion test was run as described in Example 1. The following results were obtained:

| Donor Element | Tape Test |
|---|---|
| A (0.11 g/m$^2$) | E |
| A (0.43 g/m$^2$) | E |
| B (0.11 g/m$^2$) | U |
| B (0.43 g/m$^2$) | U |

The results again indicate that the donor elements having the subbing layer in accordance with the invention provided excellent adhesion, in contrast to the control elements having a gelatin subbing layer.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a poly(ethylene terephthalate) support having thereon, in order, a subbing layer and a dye layer comprising a dye dispersed in a cellulosic binder, the improvement wherein said subbing layer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride, said subbing layer providing increased adhesion between said support and said dye layer.

2. The element of claim 1 wherein said ethylenically unsaturated monomer comprises acrylonitrile and said ethylenically unsaturated carboxylic acid comprises either acrylic acid or itaconic acid.

3. The element of claim 1 wherein said subbing layer comprises from about 5 to about 35 percent by weight of acrylonitrile, from about 2 to about 10 percent by weight of acrylic acid, and from about 55 to about 85 percent by weight of recurring units of vinylidene chloride.

4. The element of claim 1 wherein said dye layer comprises a sublimable dye dispersed in a cellulose mixed ester binder.

5. The element of claim 4 wherein said cellulose mixed ester is cellulose acetate butyrate.

6. The element of claim 1 wherein the side of the support opposite the side having thereon said dye layer is coated with a slipping layer comprising a lubricating material.

7. The element of claim 1 wherein said dye layer comprises sequential repeating areas of cyan, magenta and yellow dye.

8. In a process of forming a dye transfer image comprising (a) imagewise-heating a dye-donor element comprising a poly(ethylene terephthalate) support having thereon, in order, a subbing layer and a dye layer comprising a dye dispersed in a cellulosic binder, and (b) transferring a dye image to a dye-receiving element to form said dye transfer image, the improvement wherein said subbing layer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride, said subbing layer providing increased adhesion between said support and said dye layer.

9. The process of claim 8 wherein said ethylenically unsaturated monomer comprises acrylonitrile and said ethylenically unsaturated carboxylic acid comprises either acrylic acid or itaconic acid.

10. The process of claim 8 wherein said subbing layer comprises from about 5 to about 35 percent by weight of acrylonitrile, from about 2 to about 10 percent by weight of acrylic acid, and from about 55 to about 85 percent by weight of recurring units of vinylidene chloride.

11. The process of claim 8 wherein said support is coated with sequential repeating areas of cyan, magenta and yellow dye, and said process steps are sequentially performed for each color to obtain a three-color dye transfer image.

12. In a thermal dye transfer assemblage comprising:

(a) a dye-donor element comprising a poly(ethylene terephthalate) support having thereon, in order, a subbing layer and a dye layer comprising a dye dispersed in a cellulosic binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said subbing layer comprises from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride, said subbing layer providing increased adhesion between said support and said dye layer.

13. The assemblage of claim 12 wherein said ethylenically unsaturated monomer comprises acrylonitrile and said ethylenically unsaturated carboxylic acid comprises either acrylic acid or itaconic acid.

14. The assemblage of claim 12 wherein said subbing layer comprises from about 5 to about 35 percent by weight of acrylonitrile, from about 2 to about 10 percent by weight of acrylic acid, and from about 55 to about 85 percent by weight of recurring units of vinylidene chloride.

15. The assemblage of claim 12 wherein said dye layer comprises a sublimable dye dispersed in a cellulose mixed ester binder.

16. The assemblage of claim 15 wherein said cellulose mixed ester is cellulose acetate butyrate.

17. The assemblage of claim 12 wherein the side of the support of the dye donor element opposite the side having thereon said dye layer is coated with a slipping layer comprising a lubricating material.

18. The assemblage of claim 12 wherein said dye layer comprises sequential repeating areas of cyan, magenta and yellow dye.

* * * * *